US005183535A

United States Patent [19]

Tikka

[11] Patent Number: 5,183,535

[45] Date of Patent: Feb. 2, 1993

[54] PROCESS FOR PREPARING KRAFT PULP USING BLACK LIQUOR PRETREATMENT REACTION

[75] Inventor: Panu Tikka, Kantvik, Finland

[73] Assignee: Sunds Defibrator Rauma Oy, Finland

[21] Appl. No.: 794,795

[22] Filed: Nov. 19, 1991

Related U.S. Application Data

[63] Continuation of Ser. No. 563,438, Aug. 7, 1990, abandoned.

[30] Foreign Application Priority Data

Feb. 9, 1990 [FI] Finland ..... 900663

[51] Int. Cl.[5] ..... D21C 1/06; D21C 11/00

[52] U.S. Cl. ..... 162/19; 162/37; 162/40; 162/41

[58] Field of Search ..... 162/19, 37, 39, 40, 162/41, 47

[56] References Cited

U.S. PATENT DOCUMENTS 4,236,961 12/1980 Green ..... 162/61
4,578,149 3/1986 Fagerlund ..... 162/47
4,764,251 8/1988 Ostman ..... 162/39
4,814,942 3/1989 MacLeod et al. .
4,849,052 7/1989 Grant ..... 162/39

FOREIGN PATENT DOCUMENTS 29611 11/1958 Finland .
54155 3/1979 Finland .
71176 8/1986 Finland .
76384 6/1988 Finland .
63268 6/1989 Finland .
101369 4/1941 Sweden .
309530 7/1969 Sweden .

*Primary Examiner*—Karen M. Hastings
*Attorney, Agent, or Firm*—Lerner, David, Littenberg, Krumholz & Mentlik

[57] ABSTRACT

Processes for prepariing kraft pulp are disclosed. The processes include pretreating cellulosic material or chips with spent cooking liquor at the temperature of about 20° to 100° C., followed by heating the impregnated chips at the temperature of from about 120° to 180° C., followed by digestion of the lignin with white liquor, which is facilitated by using this pretreatment process.

21 Claims, 5 Drawing Sheets

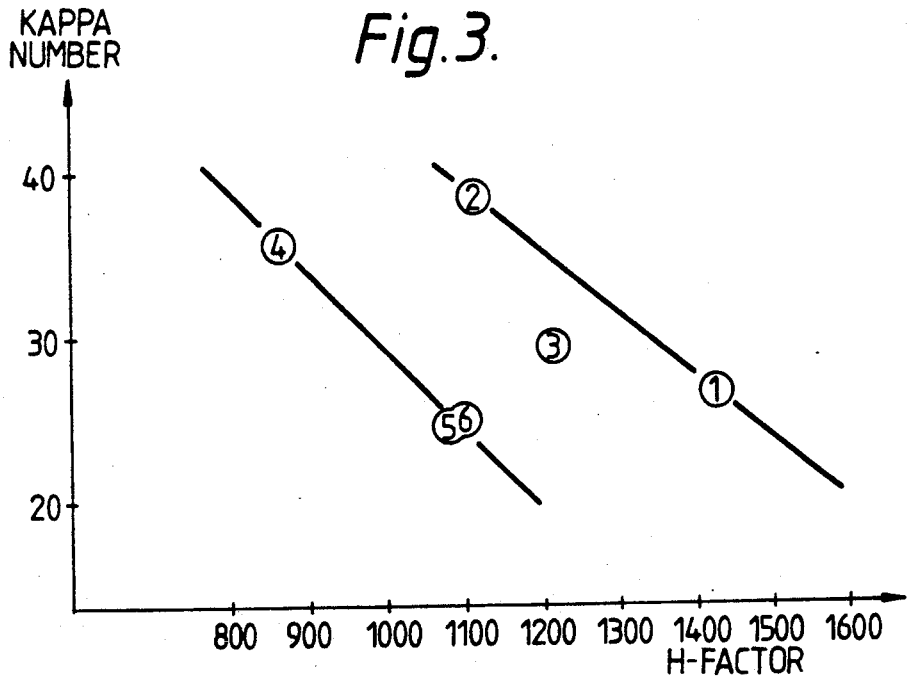
KAPPA NUMBERS OF PULPS VERSES H-FACTOR.
POINT NUMBERS AS EXPERIMENTAL COOK NUMBERS IN TEXT
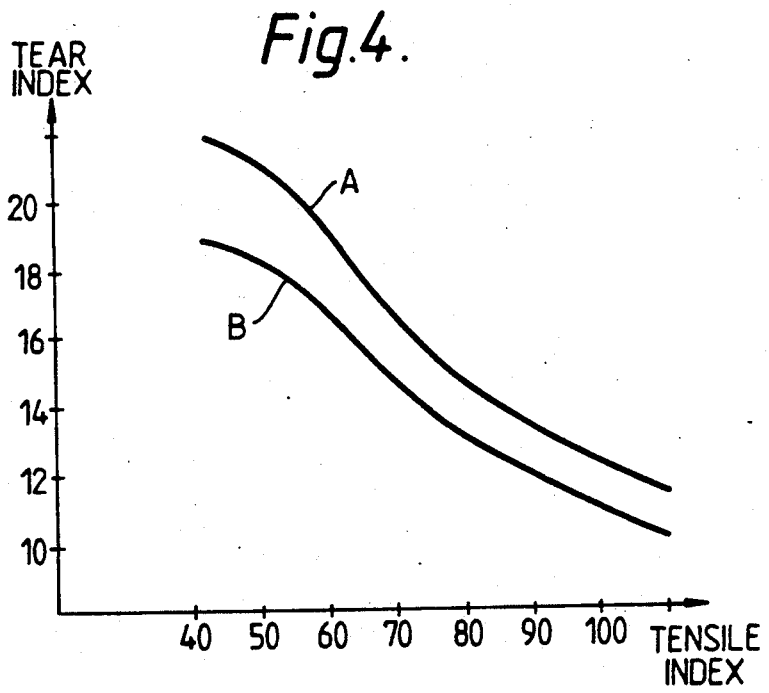
PULP STRENGTH AS TEAR-TENSILE RELATIONSHIP,A) COOKS INCLUDING BLACK LIQUOR TREATMENT STAGE,B) NO TREATMENT STAGE, COOKS CONTINUED BY WHITE LIQUOR FILL AFTER WARM BLACK LIQUOR IMPREGNATION.

PULP STRENGTH AS TEAR-TENSILE RELATIONSHIP FROM PULPS COOKED TO VERY LOW KAPPA NUMBERS, SB) WITH THE INVENTED BLACK LIQUOR - TEMPERATURE TREATMENT, C) CONVENTIONAL SULPHATE COOK.

TEMPERATURE - TIME PROFILES OF: "DTP" VERY FAST COOK ENABLED BY BLACK LIQUOR TREATMENT STAGE AND "NTP" CONSTANT TEMPERATURE COOKING WITH THE SAME BLACK LIQUOR TREATMENT

PROCESS FOR PREPARING KRAFT PULP USING BLACK LIQUOR PRETREATMENT REACTION

This is a continuation of application Ser. No. 07/563,438 filed Aug. 7, 1990 now abandoned.

FIELD OF THE INVENTION

The present invention relates to a process for preparing kraft pulp. More particularly, the present invention relates to processes for preparing kraft pulp in which cellulosic material is treated with white or fresh liquor for dissolving the lignin therein. The present invention specifically relates to the pretreatment of the lignin-containing material before the lignin digestion step.

BACKGROUND OF THE INVENTION

In the various kraft pulp processes cellulosic material or chips are generally treated at elevated temperatures with alkaline cooking liquor containing sodium hydroxide and sodium hydrogen sulfide. In these processes, fresh cooking liquor is generally referred to as white liquor, and spent liquor is generally referred to as black liquor.

On a chemical basis, the kraft pulp process used industrially is the same today as was the case one hundred years ago. While it is true that many different chemical means have been proposed for the purpose of improving factors such as the yield and selectivity of the processes, none of these proposals has led to acceptable practical solutions to these problems because each of them has entailed complicated equipment, additional process steps or the use of expensive chemicals.

In addition, different chemical methods for the pretreating of chips have also been proposed. Many of these proposed chemical pretreatment methods have been based upon the use of hydrogen sulfide or bisulfide. For example, Finnish Patent No. 29611 describes a pretreatment process utilizing hydrogen sulfide under elevated pressure. Also, Swedish Patent No. 309530 relates to a pretreatment process utilizing liquid hydrogen sulfide at a pH of between 4 and 10. Polysulfide treatment has also been proposed as a second pretreatment step.

The kraft process, however, has been developed by means of different technical processing means. In particular, the need to save energy has led to new solutions, the most important of which have been continuous cooking processes (see, e.g., Finnish Patent No. 54155). The equipment used in such continuous cooking processes can include the use of several co- and countercurrent circulations, as well as separate impregnation vessels.

Batch processes have also been developed for the purpose of saving energy. In many of the processes which have thus been developed, hot black liquor is displaced from the digester prior to discharge. This displaced liquor is then used for preheating the chips, or as cooking liquor in subsequent batches (see, e.g., U.S. Pat. No. 4,578,149 and Finnish Laid Open Publication No. 71176).

It has also been proposed to improve the quality of the pulp being produced by avoiding digester discharge which utilizes hard hot blow techniques. This can be accomplished by using the cold blow method (see, e.g., Finnish Patent Application No. 791205), or by means of pump discharge (see, e.g., U.S. Pat. No. 4,814,042).

SUMMARY OF THE INVENTION

In accordance with the present invention the objects of this invention and improvements in the kraft pulp process have now been provided by means of a process for the preparation of kraft pulps from lignin-containing cellulosic materials, which comprise impregnating the cellulosic material with spent alkaline cooking liquor at a temperature of between about 20° and 100° C., heating the impregnated cellulosic material at a temperature of between about 120° and 180° C., and delignifying the heated cellulosic material with fresh alkaline cooking liquor.

In accordance with one embodiment of the process of the present invention, impregnating of the cellulosic material with spent alkaline cooking liquor employs liquor having a pH of between about 11.5 and 13.5, and preferably between about 12.5 and 13.5.

In accordance with a preferred embodiment of the process of the present invention, heating of the impregnated cellulosic material is carried out for a period of from about 1 to 30 minutes, whereby the pH of the spent alkaline cooking liquor impregnated into the cellulosic material is decreased to between about 9 and 11, and preferably to between about 9.5 and 10.5.

In accordance with another embodiment of the process of the present invention, the spent and fresh alkaline cooking liquor comprises sodium hydroxide. Preferably, the spent alkaline cooking liquor has a residual sodium hydroxide content of between about 4 and 20 grams of sodium hydroxide per liter, and more preferably between about 6 and 15 grams of sodium hydroxide per liter.

In accordance with another embodiment of the process of the present invention the step of heating the impregnated cellulosic material is carried out at a temperature of between about 135° and 155° C. Preferably this step is carried out for a period of between about 10 and 30 minutes.

In accordance with one preferred embodiment of the process of the present invention the cellulosic material is hardwood and the step of delignifying the heated cellulosic material is carried out using an H-factor of between about 900 and 1000, in order to produce a readily fiberized paper pulp.

In accordance with another preferred embodiment of the process of the present invention the cellulosic material is softwood and the step of delignifying the heated cellulosic material is carried out using an H-factor of between about 400 and 700, in order to produce a readily fiberized paper pulp.

In accordance with another embodiment of the process of the present invention the step of delignifying the heated cellulosic material is carried out at a temperature of between about 180° and 190° C.

The principal advantage of the process of the present invention is that digestion of the lignin with white liquor is greatly facilitated by means of this process.

BRIEF DESCRIPTIONS OF THE DRAWINGS

Preferred embodiments of the present invention will be described in greater detail with reference to the accompanying drawings.

FIG. 3 is a graphical representation of the results of Example 2 illustrating the H-factor as a function of kappa number.

FIG. 4 is a graphical representation of the quality of pulp based on tear index as a function of tensile strength as discussed in Example 2.

DETAILED DESCRIPTION

Figure 1:
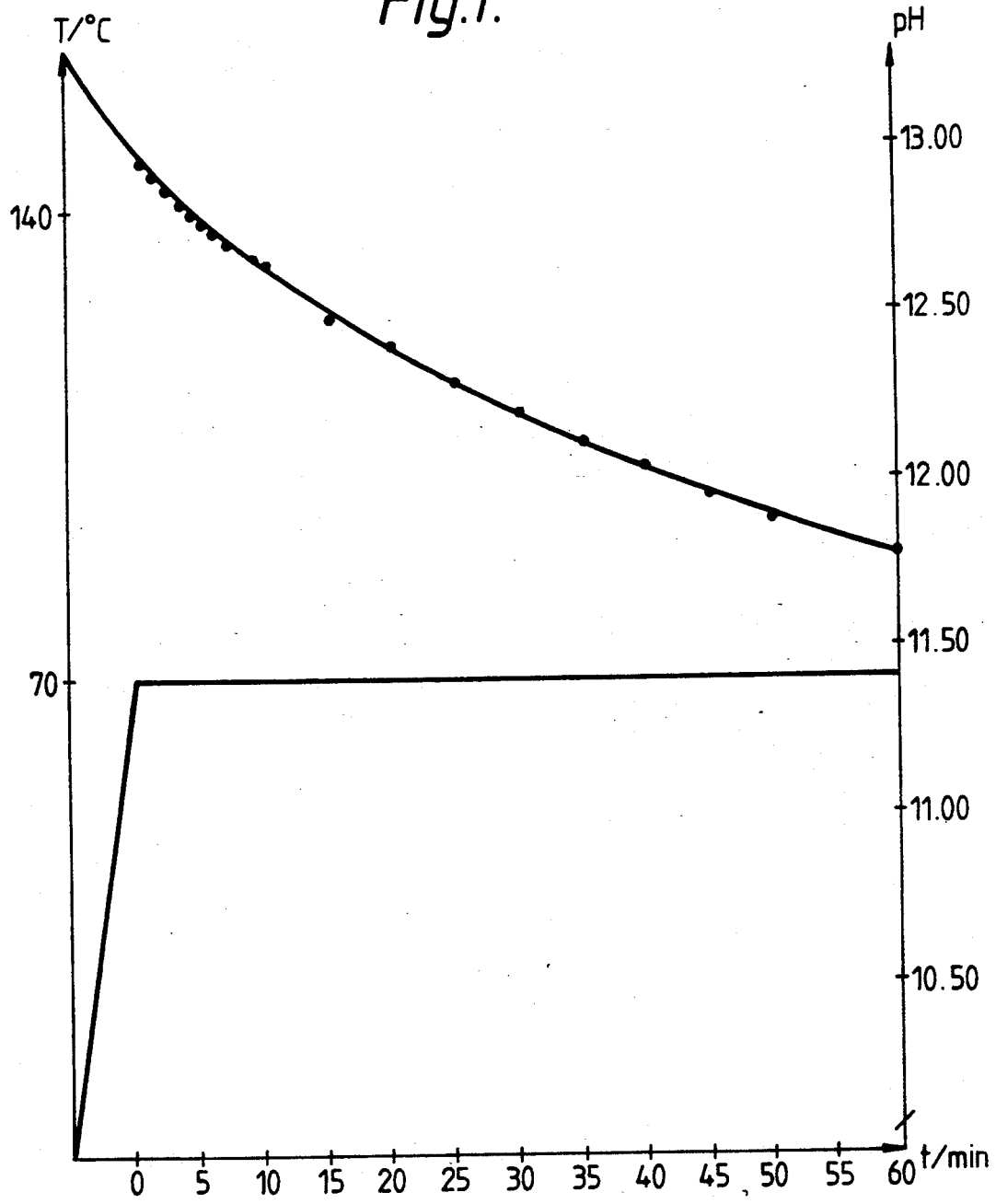
FIG. 1 is a graphical representation of time, temperature, and pH as described in Example 1.

It is essential that in accordance with the present invention the chips are pretreated with spent cooking liquor, or so-called black liquor. This pretreatment takes place in two steps. In the first step the chips are impregnated with the spent liquor, and in the second step they are reacted with it.

In the impregnation step the chips are essentially filled with the spent liquor. The temperature of this impregnation step must be below 100° C. in order to avoid reaction therewith on the surface of the chips. In practice temperatures of from about 20° to 100° C. can be utilized. The time of this impregnation step should be from at least about 10 minutes, and preferably between about 15 and 20 minutes. Impregnation times of more than about 30 minutes are unnecessary.

The pH of the spent liquor is between about 12.5 and 13.5, and the residual alkali content is from about 4 to 20 g NaOH/l, and preferably between about 6 and 15 g NaOH/l.

The pretreatment reaction or heating step which follows the impregnation step is carried out at an elevated temperature of from about 120° to 180° C. The reaction time depends on the temperature which is utilized, and is generally from about 1 to 30 minutes. Preferably, a reaction temperature of from about 135° to 155° C., and a reaction time of from about 10 to 30 minutes is utilized. In this heating step the residual chemicals in the black liquor react with the wood material, and alkali is consumed. The pH within the chips is thus decreased to from about 9 to 10. It is believed that in this altered chemical environment sulfur compounds react with the lignin, and thereby render it more reactive in the digestion step which follows thereafter. It is also assumed that hydrogen sulfide reacts with the end groups of carbohydrates in the wood, thus protecting them against alkaline decomposing reactions.

Pretreatment of the chips in this manner renders the subsequent digestion step substantially easier. The severity of the digestion conditions which are required (i.e., reaction temperature and time) is generally determined by the so-called H-factor. In a normal kraft process of, e.g., Scandinavian softwood, H-factors of from about 1600 to 1800 are required. In the present process, H-factors can be diminished by about 400 to 1000. This means that the overall digestion time can be significantly shortened. On the other hand, it has also been observed that exceptionally high digestion temperatures, such as from about 180° to 190° C., can be employed in the present process. This can lead to further shortening of the digestion time. In conventional kraft processes, the digestion step generally takes about one hour. In accordance with the present invention, however, digestion times of about one-half hour are now possible.

An additional advantage of the present process is the increased selectivity of the delignification reaction. This, in turn, leads to higher yields and superior pulp quality, or to a lower consumption of cooking chemicals.

Because of the increased selectivity of the digestion step, and of the quality and yield of pulp, the digestion reaction can now also be run for a longer period of time, and a lower lignin concentration can thus be achieved than is the case in conventional processes. The pulp which is obtained thereby thus requires less bleaching, which, in turn, decreases the amount of harmful compounds which are discharged from the bleach plant into the waste waters therefrom.

Accordingly, by utilization of the present process there are a number of advantages which can be achieved, depending upon one's specific individual requirements.

It is essential in understanding the role of the present invention that it be appreciated that it constitutes an intermediate process stage before the reaction environment is rendered strongly alkaline by the addition of fresh or white liquor. Accordingly, that stage can be incorporated with virtually any type of cooking process which utilizes kraft delignification.

In batch cooking techniques, all of the steps can be carried out in the same reactor, i.e., the digester. After the black liquor impregnation step, the contents of the digester are heated to a temperature in the range of the reaction temperature in the case of (i) conventional batch processes, by means of the digester circulation being equipped with a heat exchanger, or by direct steam injection, and (ii) in case of low energy batch cooking, using the displacement technique, by displacing the colder impregnation black liquor with hotter black liquor for the purpose of carrying the process heat back to the digester.

Another embodiment of this invention utilizing batch digesters is to impregnate the chips with the black liquor in the context of chip filling in separate equipment. The reaction stage would thus appear as the first step in the digester after chip filling, and could be very effectively carried out by the use of direct steam subsequent to the draining of the impregnation black liquor, or by displacing the impregnation/filling media black liquor by hotter black liquor. In this case continuous impregnation is carried out while charging the digester and is combined with batch cooking techniques, thus resulting in (i) compensation for the extra time spent with the black liquor stage, and (ii) reduction of the total cooking cycle time due to the greater speed of the cooking step.

The present invention can also be carried out in connection with continuous cooking processes. The continuous digester equipment presently being used, including separate impregnation vessels and various co- and countercurrent circulations, effectively segregate the cooking process into several steps, in which the present invention can include starting the process with black liquor and without white liquor. Accordingly, the chips are fed into the digester or impregnation vessel along with the black liquor, the temperature is elevated to the reaction range by heating with the aid of liquor circulation-heat exchanger. After a process delay which corresponds to the time required for the black liquor and wood to interact, the white liquor is then fed into the digester, displacing the black liquor, the temperature is again increased by means of a circulation-heat exchanger and the rest of the process is carried out in the conventional manner. An alternative continuous process is to carry out the black liquor treatment stage as a countercurrent operation.

In continuous cooking processes, application of the present invention can lead to remarkable results. Utilizing the present conventional processes, continuous cooking to kappa numbers of about 30 generally requires a reaction time of from 60 to 90 minutes in the cooking temperature range. If extended cooking to lower kappa numbers of between about 23 and 25 are required, an extra cooking stage, and an additional 60 minutes of cooking time is generally required, thus totaling at least two hours of cooking time. By utilizing the acceleration of the delignification step of this invention, however, the cooking time, and the size of the cooking zone in the continuous digester, can be cut in half, therefore also rendering the equipment cheaper, and its operation far simpler.

EXAMPLE 1

A forced circulation 20 liter digester was charged with pine chips in an amount corresponding to 3 kg of absolutely dry wood, and 15 liters of spent black liquor was added (pH 13.2, residual alkali concentration 7 g NaOH/l as effective alkali), so that the liquid ratio was 5:1. The digester was then closed, and pressurized with nitrogen in order to permit the taking of samples and the equalization of impregnation.

The circulation was initiated, and the temperature of the digester was elevated from 20° C. to 70° C. in five minutes by means of a heat exchanger, and it was then held at that temperature for 55 minutes. Samples were then taken from the circulation, cooled down to 25° C., and their pH measured. The procedure and development of the pH in the Cook are shown in FIG. 1.

The procedure was then repeated using a different temperature profile, as follows:

| | |
|---|---|
| 25–70° C. | 5 min. |
| 70° C. | 10 min. |
| 70–140° C. | 10 min. |
| 140° C. | 20 min. |

Figure 2:
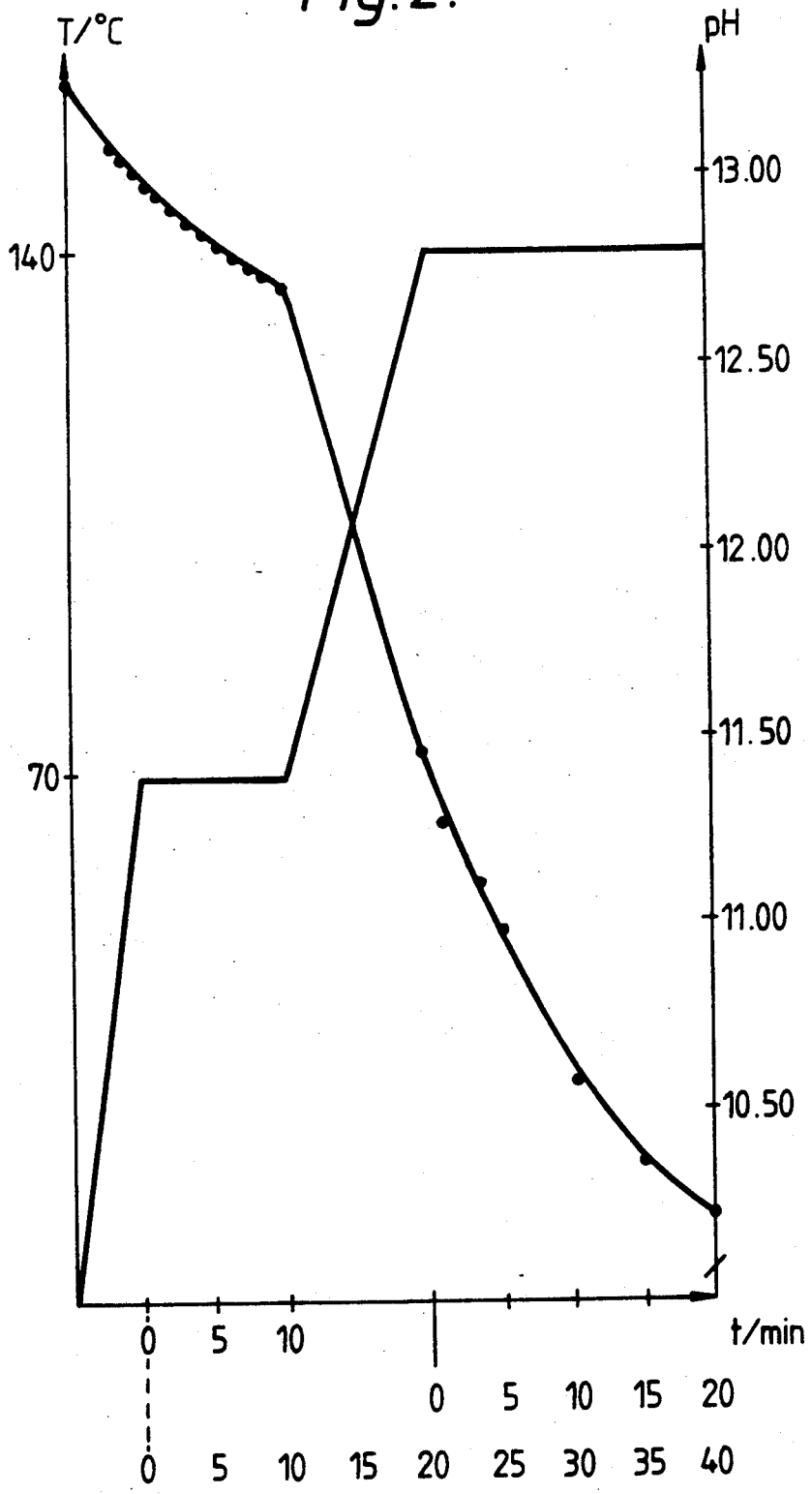
FIG. 2 is a graphical representation of time, temperature, and pH as described in Example 2.

This procedure, and development of the pH of this Cook, are shown in FIG. 2

It can be seen in FIGS. 1 and 2 that the black liquor treatment at 70° C. consumed the residual alkali by only a small amount, and the pH fell rapidly when the temperature was elevated. When the temperature had been elevated to 140° C. in 10 minutes, the pH had thus already fallen to 11.5, and when the treatment was continued at 140° C., in 20 minutes the pH further fell to 10.2.

This Example demonstrates that when the system is heated above 100° C. a new reaction phase is initiated in which the residual alkali is rapidly consumed. Since the final pH's were 11.8 and 10.2, it can be seen that, in the latter experiment the H+-ion concentration is almost one hundred times greater than is the case in the former case. Since the pH could only be measured from the circulating cooking liquid, it is thus clear that in the latter experiment within the chips themselves the consumption of alkali would actually be even greater.

EXAMPLE 2

An industrial batch digester having a capacity of 140 $m^3$ was filled with pine chips and spent black liquor (pH 13.4) from previous cookings. The temperature was elevated to 140° C., and maintained at that temperature for 15 minutes. The pH thus decreased to 11. White liquor was then added so that the alkali dosage was 18.2% of effective alkali, given as $Na_2O$. The temperature was then raised to 170° C., and digestion continued to the desired level of delignification reduction, by altering the digestion time. The digester was then discharged, H-factor utilized registered, and the pulp was analyzed.

This digestion procedure was carried out six times by changing the strength of the black liquor pretreatment, but at the same time keeping the alkali dosage and the overall procedure constant. The following results were obtained:

Experimental Cook 1

Black liquor impregnation at 85° C. for 20 minutes. White liquor was added directly after filling with black liquor.

| | |
|---|---|
| H-factor | 1420 |
| Kappa number | 27.0 |
| Viscosity | 1080 |

Experimental Cook 2

Black liquor impregnation at 90° C. for 20 minutes. White liquor was added directly after filling with black liquor.

| | |
|---|---|
| H-factor | 1110 |
| Kappa number | 38.3 |
| Viscosity | 1135 |

Experimental Cook 3

Black liquor impregnation at 90° C. for 20 minutes, and black liquor treatment at 125° C. for 10 minutes.

| | |
|---|---|
| H-factor | 1214 |
| Kappa number | 29.6 |
| Viscosity | 1115 |

Experimental Cook 4

Black liquor impregnation at 90° C. for 20 minutes, and black liquor pretreatment at 145° C. for 20 minutes.

| | |
|---|---|
| H-factor | 860 |
| Kappa number | 36 |
| Viscosity | 1160 |

Experimental Cook 5

(Like Cook No. 4)

| | |
|---|---|
| H-factor | 1077 |
| Kappa number | 25.3 |
| Viscosity | 1065 |

Experimental Cook 6

(Like Cook No. 4)

| | |
|---|---|
| H-factor | 1089 |
| Kappa number | 25.4 |
| Viscosity | 1045 |

These results are also presented in FIG. 3, which shows the H-factor in each digestion as a function of the kappa number of the pulp obtained therein.

The effect of black liquor pretreatment on the acceleration of digestion can be seen by observing the H-factor required, or the digestion time at constant temperature. In order to achieve a kappa number of 30, 1325 H-factor units are required if the impregnated chips are not heated, but digestion is carried out immeditely after the impregnation step (see line-through points 1 and 2). When mild heating was utilized (125° C. for 10 minutes), 1220 H-factor units were required (see point 3). When strong pretreatment was utilized (145° C. for 20 minutes), a kappa number of 30 was achieved with 980 H-factor units (see line-through points 4, 5 and 6). With conventional batch digesting techniques about 1600 to 1800 H-factor units are required in order to achieve a kappa number of 30.

The effect upon the quality of the pulp was examined by combining the pulp samples from Cook Nos. 1 and 2, so as to represent cooking without black liquor treatment, and by combining the pulp samples from Cook Nos. 4, 5 and 6, so as to represent cooking with black liquor treatment. In FIG. 4 the quality of these pulps is compared by setting forth the tear index as a function of the tensile strength. It can thus be seen that, e.g., at a tensile strength of 70, the tear index of the pulp thus obtained employing the treatment (see curve A) is 1 to 2 units higher than that of pulps produced without utilizing this treatment.

EXAMPLE 3

In this example two experimental Cooks were carried out to far greater degrees of delignification.

Cook SB

This Cook was carried out in the manner of Experimental Cook Nos. 4, 5 and 6 in Example 2 with the following exceptions: An alkali charge of 20% effective alkali as $Na_2O$ per wood

| | |
|---|---|
| H-factor | 1850 |
| Pulp kappa number | 15.2 |
| Pulp viscosity | 905 |

Cook C

This Cook was carried out in the manner of a conventional batch Cook, without black liquor impregnation and treatment stages:

The alkali charge was 21% effective alkali as $Na_2O$ per wood

| | |
|---|---|
| H-factor | 2000 |
| Pulp kappa number | 71.1 |
| Pulp viscosity | 905 |

Figure 5:
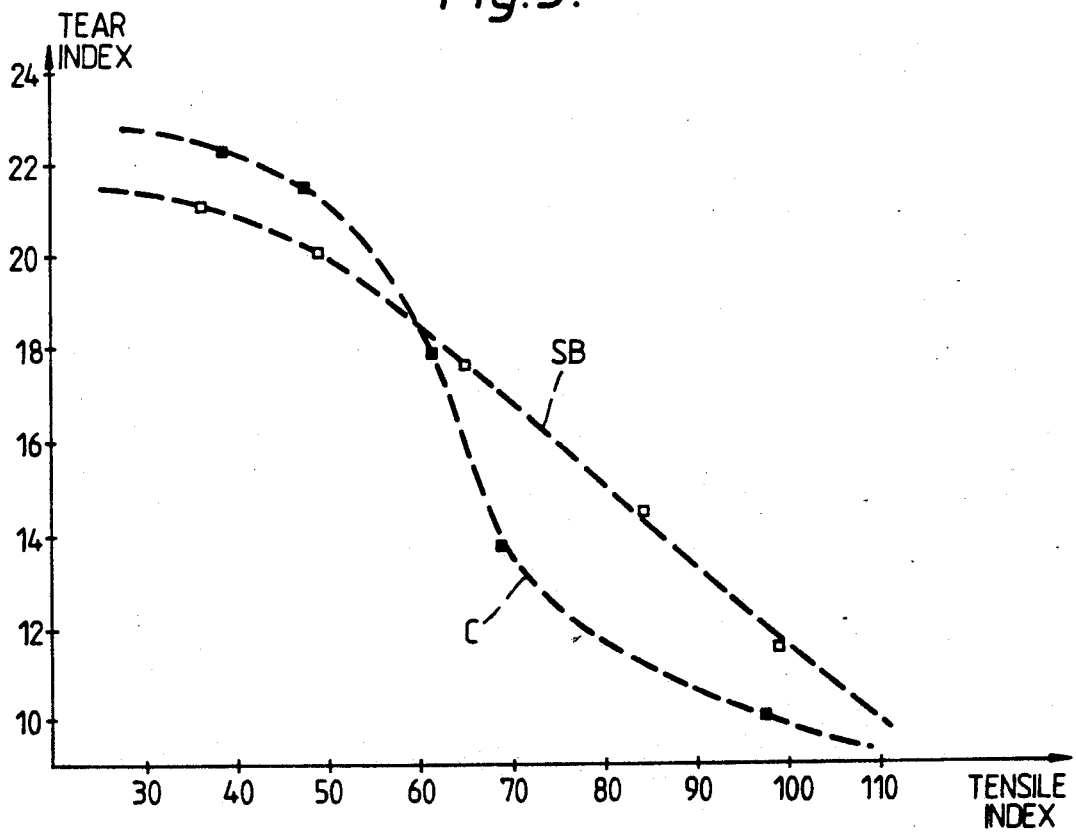
FIG. 5 is a graphical representation of pulp quality based on tear strength and tensile strength as described in Example 3.

The pulps were analyzed in terms of strength by tear-tensile comparison, as is illustrated in FIG. 5. It is clear therefrom that, when the tensile index is increased to the useful range for paper making by beating (i.e., a tensile index of from 70 to 80), the conventionally cooked pulp loses its tear strength (curve "C"), while the pulp cooked with the treatment stage of the present invention still maintains its tear strength (curve "SB"). The advantage for pulp "SB" is three tear index units, or from 20 to 25% higher.

At present, cooked Scandinavian market pulps, at a kappa number of 30, demonstrate a tear index of from 13 to 15 at a tensile index of 70. In terms of present-day pulping technology, those few mills which apply cooking to lower than normal kappa numbers generally regard a kappa number of from 23 to 25 as representative of "extended cooking." Results of a nature of those shown above, which were obtained by using the beneficial black liquor-temperature treatment hereof, have only been achievable in the past after a post-digester oxygen delignification process.

EXAMPLE 4

This example demonstrates a unique way to take advantage of the black liquor-temperature treatment stage of this invention. It is generally known, both in mill practice and textbooks, that the maximum sulphate cooking temperature should not exceed 175° C. due to the severe pulp strength losses which result therefrom, as well as the lower yield which will then be realized.

An experimental cook was carried out as in Example 2, Cooks 5 and 6, except that the cooking temperature was not limited to 170° C. (curve "NTP" in FIG. 6), but instead the cook was heated up as far as was possible with the available steam and heat exchangers (curve "DTP" in FIG. 6). The end temperature was 181° C. All other cooking conditions were equal.

Temperature of the black liquor treatment was 145° C. The time of black liquor treatment was 20 minutes. The alkali charge was 18.2% effective alkali as $Na_2O$ per wood

| | |
|---|---|
| H-factor | 1000 |
| (Example 2, Cooks 5, 6: | 1080) |
| Pulp kappa number | 28.1 |
| (Example 2, Cooks 5, 6: | 25.4) |

The tear-tensile relationship of the pulp was analyzed in order to evaluate the pulp strength. At a useful tensile index of 70, the tear index was 16, which equals the value found on curve "A" in FIG. 4 in Example 2, applying a normal cooking temperature and black liquor treatment. This slightly exceeded that of a normal cooking temperature with no black liquor treatment.

Figure 6:
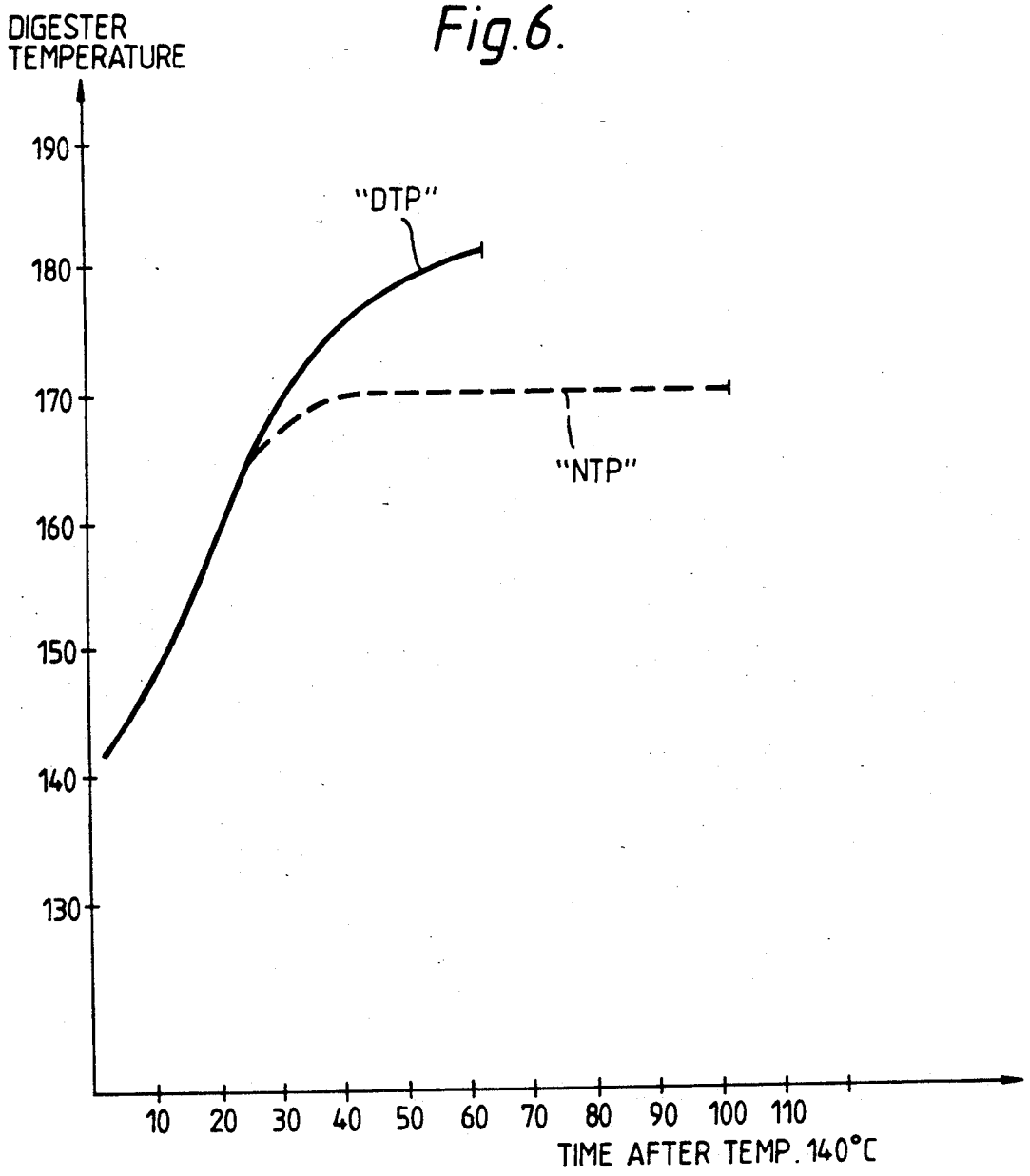
FIG. 6 is a graphical representation of a comparison between cooking temperature and time profiles as described in Example 4.

This retention of pulp strength can be of considerable significance when greater production per digester volume unit is required. FIG. 6 sets forth a comparison between cooking temperature and time profiles for the Cook in this Example, and that of Cook Nos. 5 and 6 in Example 2, representing normal cooking temperatures.

Curve "DTP"

| | |
|---|---|
| End temperature | 181° C. |
| Final H-factor | 1000 |
| Time to end from 140° C. | 60 minutes |

Curve "NTP"

| | |
|---|---|
| End temperature | 170° C. |
| Final H-factor | 1080 |
| Time to end from 140° C. | 100 minutes |

It is evident from these results that the cooking time after 40 minutes of heating was cut down to 20 minutes by the high temperature profile, instead of 60 minutes with constant 170° C. cooking temperature. A 40 minute savings in cooking time easily represents a 15 to 20% lower total cycle time, with the corresponding opportunity to increase production without compromising pulp quality. In terms of yield it appears that the yield of the very fast cooking method of this invention is then 1 to 2% higher.

EXAMPLE 5

The results of this Example demonstrate that the pulps inside the digester prepared in accordance with the present invention are in extremely good condition to resist the physical damage during the discharge which arises by various blow methods, as compared to pulps cooked without the use of such a black liquor treatment stage.

The pulp conditions prior to the blow were determined by hanging baskets filled with the same chip material inside the digester. After the blow, pulp which had not been blown could thus be recovered from these baskets, and compared to samples of the blown pulp.

In this case, the analysis carried out was in terms of a so-called strength delivery, which is the percentage of the pulp strength as tear index at a tensile index of 70 measured in the blown pulp as compared to that of non-blown pulp in the basket.

The Cooks were carried out with a black liquor treatment stage as described in Example 2, Cook Nos. 4–6, discharged by: hot blow, directly from full cooking temperature; cold blow, after cooling displacement to under 100° C.; and pump discharge after cooling displacement.

Reference data is given from U.S. Pat. No. 4,814,042, which represents the effect of the blow method subsequent to conventionally cooked sulphate batch cooks.

The following table summarizes these results.

TABLE 1

(Pulp quality given as strength delivery percentages of blown pulp compared to that of non-blown pulp strength.)

| Discharge Method | Sulphate Cooking with Treatment of This Invention | Conventional Batch Cooking |
|---|---|---|
| Hot Blown Pulp | 95 | 77 |
| Cold Blown Pulp | 99 | 85 |
| Pump Discharged Cold Pulp | 99 | 90 |

It is evident from Table 1 that pulp cooked by a method comprising the black liquor treatment of this invention does not require any improvement in terms of strength delivery, and the pulp is in optimum condition.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor under positive pressure for a period of time sufficient to provide an equalization of impregnation of said cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled, impregnated cellulosic material to a pretreatment reaction wherein the impregnated alkaline cooking liquor reacts with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

2. The process for the preparation of kraft pulp of claim 1 wherein said impregnation step is conducted for between about 10 and about 30 minutes.

3. The process for the preparation of kraft pulp of claim 2 wherein said impregnation step is conducted for between about 15 and about 20 minutes.

4. The process for the preparation of kraft pulp of claim 1 wherein said impregnation temperature ranges from between about 20° C. to about 100° C.

5. The process for the preparation of kraft pulp of claim 4 wherein said impregnation temperature ranges from between about 70° C. to about 100° C.

6. The process for the preparation of kraft pulp of claim 1 wherein said pretreatment reaction is conducted at a temperature of between about 120° C. and about 180° C.

7. The process for the preparation of kraft pulp of claim 1 wherein said pretreatment reaction is conducted over a time of between about 10 and about 30 minutes.

8. The process for the preparation of kraft pulp of claim 1 wherein said pretreatment reaction includes elevating the temperature of said impregnated alkaline cooking liquor and said cellulosic material to between about 135° C. and about 155° C. by directly heating said alkaline cooking liquor.

9. The process for the preparation of kraft pulp of claim 1 wherein said pretreatment reaction includes elevating the temperature of said impregnated alkaline cooking liquor and said cellulosic material to about 140° C. by displacing non-impregnated alkaline cooking liquor.

10. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor under positive pressure for a period of time sufficient to provide an equalization of impregnation of said cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled impregnated cellulosic material to a pretreatment reaction by displacing the non-impregnated alkaline cooking liquid from the vessel with a liquor having a temperature of between about 135° C. and about 155° C., thereby causing said impregnated alkaline cooking liquor to react with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

11. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor under positive pressure for a period of time sufficient to provide an equalization of impregnation of said alkaline cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled impregnated cellulosic material to a pretreatment reaction by elevating the temperature of said impregnated alkaline cooking liquor and said cellulosic material to between about 100° C. and about 140° C. by directly heating said alkaline cooking liquor wherein said impregnated alkaline cooking liquor reacts with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

12. The process for the preparation of kraft pulp of claims 10 or 11 wherein said impregnation step is conducted for between about 10 and about 30 minutes.

13. The process for the preparation of kraft pulp of claim 12 wherein said impregnation step is conducted for between about 15 and about 20 minutes.

14. The process for the preparation of kraft pulp of claims 10 or 11 wherein said impregnation temperature ranges from between about 20° C. to about 100° C.

15. The process for the preparation of kraft pulp of claim 14 wherein said impregnation temperature ranges from between about 70° C. to about 100° C.

16. The process for the preparation of kraft pulp of claims 10 or 11 wherein said pretreatment reaction is conducted over a time of between about 10 and about 30 minutes.

17. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor, under positive pressure, for between about 10 and about 30 minutes to provide for equalization of impregnation and so as to essentially fill said cellulosic material with said alkaline cooking liquor, said alkaline cooking liquor being maintained at an impregnation temperature of between about 20° C. and about 100° C. which will avoid reaction between said cooking liquor and said cellulosic material;

subjecting said essentially filled impregnated cellulosic material to a pretreatment reaction at a temperature of between about 120° C. and about 180° C. wherein the impregnated alkaline cooking liquor reacts with said cellulosic material for between about 10 and about 30 minutes to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

18. The process for the preparation of kraft pulp of claim 17 wherein said impregnation step is conducted for between about 15 and about 20 minutes.

19. The process for the preparation of kraft pulp of claim 18 wherein said impregnation temperature ranges from between about 70° C. to about 80° C.

20. The process for the preparation of kraft pulp of claim 19 wherein said pretreatment reaction is conducted over a time of between about 15 and about 20 minutes.

21. The process for the preparation of kraft pulp of claim 17, wherein said delignifying is conducted at a temperature of between about 180° C. and 190° C.

* * * * *

UNITED STATES PATENT AND TRADEMARK OFFICE

CERTIFICATE OF CORRECTION

PATENT NO. : B1 5,183,535

DATED : February 6, 1996

INVENTOR(S) : Panu Tikka

It is certified that error appears in the above-identified patent and that said Letters Patent is hereby corrected as shown below:

Column 2, line 36, "reactions" should read --reacts--.

Signed and Sealed this

Twenty-fifth Day of June, 1996

Bruce Lehman

*Attest:*

BRUCE LEHMAN

*Attesting Officer*

*Commissioner of Patents and Trademarks*

US005183535B1

REEXAMINATION CERTIFICATE (2794th)

United States Patent [19]

Tikka

[11] B1 5,183,535

[45] Certificate Issued Feb. 6, 1996

[54] PROCESS FOR PREPARING KRAFT PULP USING BLACK LIQUOR PRETREATMENT REACTION

[75] Inventor: Panu Tikka, Kantvik, Finland

[73] Assignee: Sunds Defibrator Rauma Oy, Pori, Finland

Reexamination Request:
No. 90/003,766, Mar. 28, 1995

Reexamination Certificate for:

| | |
|---|---|
| Patent No.: | **5,183,535** |
| Issued: | **Feb. 2, 1993** |
| Appl. No.: | **794,795** |
| Filed: | **Nov. 19, 1991** |

Related U.S. Application Data

[63] Continuation of Ser. No. 563,438, Aug. 7, 1990, abandoned.

[30] Foreign Application Priority Data

Feb. 9, 1990 [FI] Finland ..... 900663

[51] Int. Cl.[6] ..... D21C 1/06; D21C 11/00

[52] U.S. Cl. ..... 162/19; 162/37; 162/40; 162/41

[58] Field of Search ..... 162/19, 37, 40, 162/41

[56] References Cited

U.S. PATENT DOCUMENTS 1,687,076 10/1928 Woodhead .
2,639,987 5/1953 Sloman .

OTHER PUBLICATIONS

J. R. G. Bryce, "Pulp and Paper; Chemistry and Chemical Technology", 3d ed., vol. 1 (John Wiley & Sons, New York, 1980), pp. 377–492.

Michael Kaiser et al., "Beloit's (RDH) displacement heating at Owens–Illinois, Valdosta, Georgia", *Tappi Journal*, Oct. 1986.

*Primary Examiner*—Karen M. Hastings

[57] ABSTRACT

Processes for preparing kraft pulp are disclosed. The processes include pretreating cellulosic material or chips with spent cooking liquor at the temperature of about 20° to 100° C., followed by heating the impregnated chips at the temperature of from about 120° to 180° C., followed by digestion of the lignin with white liquor, which is facilitated by using this pretreatment process.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10, 11 and 17 are determined to be patentable as amended.

Claims 2–9, 12–16 and 18–21, dependent on an amended claim, are determined to be patentable.

1. A process for the preparation of kraft pulp from a lignin-containing cellulosic material comprising the steps of:

filling a vessel containing cellulosic material with an alkaline cooking liquor having a pH of between about 11.5 and about 13.5 and consisting essentially of spent kraft cooking liquor *containing sulfur compounds*;

impregnating said cellulosic material with said alkaline cooking liquor under positive pressure for a period of time sufficient to provide an equalization of impregnation of said cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled, impregnated cellulosic material to a pretreatment reaction [wherein the] *consisting essentially of reacting said* impregnated alkaline cooking liquor [reacts] *including said sulfur compounds* with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

10. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor:

impregnating said cellulosic material with said alkaline cooking liquor under positive pressure for a period of time sufficient to provide an equalization of impregnation of said cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled impregnated cellulosic material to a pretreatment reaction [by] *consisting essentially of* displacing the non-impregnated alkaline cooking liquid from a vessel with a *black* liquor having a temperature of between about 135° C. and about 155° C., thereby causing said impregnated alkaline cooking liquor to react with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

11. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor under positive pressure for a period of time sufficient to provide an equalization of impregnation of said alkaline cellulosic material with said alkaline cooking liquor and to essentially fill said cellulosic material with said alkaline cooking liquor, said alkaline cooking liquor being maintained at an impregnation temperature which will avoid reaction between said cooking liquor and said cellulosic material;

subjecting said essentially filled impregnated cellulosic material to a pretreatment reaction [by] *consisting essentially of* elevating the temperature of said impregnated alkaline cooking liquor and said cellulosic material to between about 100° C. and about 140° C. by directly heating said alkaline cooking liquor wherein said impregnated alkaline cooking liquor reactions with said cellulosic material under conditions sufficient to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

17. A process for the preparation of kraft pulp from lignin-containing cellulosic material comprising the steps of:

filling a vessel containing cellulosic material with an alkaline cooking liquor having a pH of between about 11.5 and about 13.5 and consisting essentially of spent kraft cooking liquor;

impregnating said cellulosic material with said alkaline cooking liquor, under positive pressure, for between about 10 and about 30 minutes to provide for equalization of impregnation and so as to essentially fill said cellulosic materials with said alkaline cooking liquor, said alkaline cooking liquor being maintained at an impregnation temperature of between about 20° C. and about 100° C. which will avoid reaction between said cooking liquor and said cellulosic material;

subjecting said essentially filled impregnated cellulosic material to a pretreatment reaction at a temperature of between about 120° C. and about 180° C. [wherein the] *consisting essentially of reacting said* impregnated alkaline cooking liquor [reacts] with said cellulosic material for between about 10 and about 30 minutes to lower the pH of said alkaline cooking liquor to between about 9 and about 11 whereby the pretreated cellulosic material is now capable of being delignified under relatively mild delignifying conditions; and delignifying said pretreated cellulosic material with fresh alkaline cooking liquor.

* * * * *